United States Patent [19]

Sun et al.

[11] 4,255,156

[45] Mar. 10, 1981

[54] PROCESS FOR REMOVAL OF SULFUR AND ASH FROM COAL

[75] Inventors: Jui-Yuan Sun, South Holland; Emmett H. Burk, Jr., Glenwood; Jin S. Yoo, Flossmoor, all of Ill.; George P. Masologites, Columbus, N.C.

[73] Assignee: Atlantic Richfield Company, Philadelphia, Pa.

[21] Appl. No.: 32,301

[22] Filed: Apr. 23, 1979

[51] Int. Cl.[3] ..... C10L 9/00; C10L 9/10

[52] U.S. Cl. ..... 44/1 SR; 44/24; 44/51

[58] Field of Search ..... 44/1 SR, 1 A, 6, 24, 44/51; 75/3

[56] References Cited

U.S. PATENT DOCUMENTS

| | | | |
|---|---|---|---|
| 3,849,111 | 11/1974 | Kihlstedt | 75/3 |
| 4,033,729 | 7/1977 | Capes et al. | 44/1 A |
| 4,138,226 | 2/1979 | Verschuur | 44/51 |
| 4,155,716 | 5/1979 | Sun et al. | 44/1 SR |

*Primary Examiner*—Carl F. Dees

*Attorney, Agent, or Firm*—John B. Goodman

[57] ABSTRACT

A process for reducing the sulfur and ash content of coal comprising: treating coal particles in a hydrocarbon oil slurry with minor amounts of a conditioning agent and water to effect agglomeration of ash and pyritic sulfur mineral matter; separating the agglomerates from the slurried coal particles; and recovering coal particles from the hydrocarbon oil.

29 Claims, No Drawings

PROCESS FOR REMOVAL OF SULFUR AND ASH FROM COAL

BACKGROUND OF THE INVENTION

This invention relates to a process for reducing the sulfur content of coal.

It is recognized that an air pollution problem exists whenever sulfur-containing fuels are burned. The resulting sulfur oxides are particularly objectionable pollutants because they can combine with moisture to form corrosive acidic compositions which can be harmful and/or toxic to living organisms in very low concentrations.

Coal is an important fuel and large amounts are burned in thermal generating plants primarily for conversion into electrical energy. Many coals generate significant and unacceptable amounts of sulfur oxides on burning. The extent of the air pollution problem arising therefrom is readily appreciated when it is recognized that coal combustion currently accounts for 60 to 65% of the total sulfur oxides emissions in the United States.

The sulfur content of coal, nearly all of which is emitted as sulfur oxides during combustion, is present in both inorganic and organic forms. The inorganic sulfur compounds are mainly iron pyrites, with lesser amounts of other metal pyrites and metal sulfates. The organic sulfur may be in the form of thiols, disulfides, sulfides and/or thiophenes chemically associated with the coal structure itself. Depending on the particular coal, the sulfur content may be primarily either inorganic or organic. Distribution between the two forms varies widely among various coals. For example, both Appalachian and Eastern interior coals are known to be rich in both pyritic and organic sulfur. Generally, the pyritic sulfur represents from about 25% to 70% of the total sulfur content in these coals.

Heretofore, it has been recognized to be highly desirable to reduce the sulfur content of coal prior to combustion. In this regard, a number of processes have been suggested for physically reducing the inorganic portion of the sulfur in coal. Organic sulfur cannot be physically removed from coal.

As an example, it is known that at least some pyritic sulfur can be physically removed from coal by grinding and subjecting the ground coal to froth flotation or washing processes. These processes are not fully satisfactory because a significant portion of the pyritic sulfur and ash are not removed. Attempts to increase the portion of pyritic sulfur removed have not been successful because these processes are not sufficiently selective. Because the processes are not sufficiently selective, attempts to increase pyrite removal can result in a large portion of coal being discarded along with ash and pyrite.

There have also been suggestions heretofore to remove pyritic sulfur from coal by chemical means. For example, U.S. Pat. No. 3,768,988 discloses a process for reducing the pyritic sulfur content of coal by exposing coal particles to a solution of ferric chloride. The patent suggests that in this process ferric chloride reacts with pyritic sulfur to provide free sulfur according to the following reaction process:

$$2FeCl_3 + FeS_2 \rightarrow 3FeCl_2 + 2S$$

While this process is of interest for removing pyritic sulfur, a disadvantage of the process is that the liberated sulfur solids must then be separated from the coal solids. Processes involving froth flotation, vaporization and solvent extraction are proposed to separate the sulfur solids. All of these proposals, however, inherently represent a second discrete process step, with its attendant problems and cost, to remove the sulfur from coal. In addition, this process is notably deficient in that it does not remove organic sulfur from coal.

In another approach, U.S. Pat. No. 3,824,084 discloses a process involving grinding coal containing pyritic sulfur in the presence of water to form a slurry, and then heating the slurry under pressure in the presence of oxygen. The patent discloses that under these conditions the pyritic sulfur (for example, $FeS_2$) can react to form ferrous sulfate and sulfuric acid which can further react to form ferric sulfate. The patent discloses that typical equations for the process at the conditions specified are as follows:

$$FeS_2 + H_2O + 2O_2 \rightarrow FeSO_4 + H_2SO_4$$

$$2FeSO_4 + H_2SO_4 + \tfrac{1}{2}O_2 \rightarrow Fe_2(SO_4)_3 + H_2O.$$

Accordingly, the pyritic sulfur content continues to be associated with the iron as sulfate. Several factors detract from the desirability of this process. High temperatures and pressures are employed which can necessitate the use of expensive reaction vessels and processing plants of complex mechanical design. Because high temperatures are employed, excessive amounts of energy can be expended in the process. In addition, the above oxidation process is not highly selective in that considerable amounts of coal itself are oxidized. This is undesirable, of course, since the amount and/or heating value of the coal recovered from the process is decreased.

Heretofore, it has been known that coal particles could be agglomerated with hydrocarbon oils. For example, U.S. Pat. Nos. 3,856,668 and 3,665,066 disclose processes for recovering coal fines by agglomerating the fine coal particles with oil. U.S. Pat. Nos. 3,268,071 and 4,033,729 disclose processes involving agglomerating coal particles with oil in order to provide a separation of coal from ash. While these processes can provide some benefication of coal, better removal of ash and iron pyrite mineral matter would be desirable.

The above U.S. Pat. No. 3,268,071 discloses the successive removal of two particulate solid minerals or metals having respectively hydrophilic and hydrophobic surfaces relative to the suspending liquid phase, by staged agglomeration with addition in each stage a separate bridging liquid capable of preferentially wetting respectively the hydrophilic or the hydrophobic surfaces.

The above U.S. Pat. No. 4,033,729 relating to removing inorganic materials (ash) from coal significantly notes that iron pyrite mineral matter has proven difficult to remove because of its apparent hydrophobic character. This disclosure confirms a long standing problem. The article, "The Use of Oil in Cleaning Coal", Chemical and Metallurgical Engineering, volume 25, pages 182–188 (1921), discusses in detail cleaning coal by separating ash from coal in a process involving agitating coal-oil-water mixtures, but notes that iron pyrite is not readily removed in such a process.

While there is much prior art relating to processes for removing sulfur and ash from coal, there remains a pressing need for a simple, efficient process for removing sulfur and ash from coal.

SUMMARY OF THE INVENTION

This invention provides a practical method for more effectively reducing the sulfur and ash content of coal. In summary, this invention involves a process for reducing the sulfur and ash content of coal comprising the steps of:

(a) providing a slurry in a hydrocarbon oil medium of coal particles containing ash and pyritic sulfur mineral matter;

(b) contacting the slurried coal particles with a promoting amount of at least one conditioning agent capable of modifying or altering the existing surface characteristics of the ash and pyritic sulfur mineral matter under conditions whereby there is effected modification or alteration of at least a portion of the contained ash and pyritic sulfur mineral matter;

(c) agglomerating the ash and pyritic sulfur mineral matter agglomerates from the hydrocarbon oil slurry; and (d) recovering a hydrocarbon oil-coal slurry wherein the coal particles have a reduced sulfur and ash content.

A notable advantage of the process of this invention is that significant sulfur and ash reduction are obtained without significant loss of the coal substrate. The desirable result is that sulfur reduction is obtained without the amount and/or heating value of the coal being significantly decreased. Another advantage is that ambient conditions (i.e., normal temperatures and atmospheric pressure) can be employed such that process equipment and design are simplified, and less energy is required. Another advantage is that solid waste disposal problems can be reduced.

DETAILED DESCRIPTION OF THE INVENTION

In its broad aspect, this invention provides a method for reducing the sulfur and ash content of coal by a process comprising the steps of:

(a) providing a slurry in a hydrocarbon oil medium of coal particles containing ash and pyritic sulfur mineral matter;

(b) contacting the slurried coal particles with a promoting amount of at least one conditioning agent capable of modifying or altering the existing surface characteristics of the ash and pyritic sulfur mineral matter under conditions whereby there is effected modification or alteration of at least a portion of the contained ash and pyritic sulfur mineral matter;

(c) agglomerating the ash and pyritic sulfur mineral matter in said hydrocarbon oil slurry, while said surfaces are modified and altered, with water;

(d) separating the ash and pyritic sulfur mineral matter agglomerates from the hydrocarbon oil slurry; and (e) recovering a hydrocarbon oil-coal slurry wherein the coal particles have a reduced sulfur and ash content.

The novel process of this invention can substantially reduce the pyritic sulfur content of coal without substantial loss of the amount and/or carbon heating value of the coal. In addition, the process by-products do not present substantial disposal problems.

In a particularly preferred embodiment steps (b) and (c) are conducted simultaneously or substantially simultaneously.

Suitable coals which can be employed in the process of this invention include brown coal, lignite, sub-bituminous, bituminous (high volatile, medium volatile, and low volatile), semi-anthracite, and anthracite. The rank of the feed coal can vary over an extremely wide range and still permit pyritic sulfur removal by the process of this invention. However, bituminous coals and higher ranked coals are preferred. Metallurgical coals, and coals which can be processed to metallurgical coals, containing sulfur in too high a content, can be particularly benefited by the process of this invention. In addition, coal refuse from wash plants which have been used to upgrade run-of-mine coal can also be used as a source of coal. Typically, the coal content of a refuse coal will be from about 25 to about 60% of weight by coal. Particularly preferred refuse coals are refuse from the washing of metallurgical coals.

In the process of this invention, coal particles containing iron pyrite mineral matter are contacted with a promoting amount of conditioning agent which can modify or alter the surface characteristics of these existing pyrite minerals such that pyrite becomes more amenable to separation upon mineral matter agglomeration when compared to the pyritic minerals prior to conditioning.

It is an important aspect of this invention that the separation from the coal particles be effectuated during the time that the surface characteristics of the pyrite are altered or modified. This is particularly true when the conditions of contacting and/or chemical compounds present in the medium can cause realteration or remodification of the surface such as to deleteriously diminish the surface differences between pyrite mineral matter and the coal particles.

Conditioning agents useful herein include inorganic compounds which can hyrolyze in water, preferably under the conditions of use, and the hydrolyzed forms of such inorganic compounds, preferably such forms which exist in effective amounts under the condition of use. Proper pH and temperature conditions are necessary for some inorganic compounds to exist in hydrolyzed form. When this is the case, such proper conditions are employed. The inorganic compounds which are hydrolyzed or exist in hydrolyzed form under the given conditions of contacting (e.g., temperature and pH) can modify or alter the existing surface characteristics of the pyrite. Preferred inorganic compounds are those which hydrolyze to form high surface area inorganic gels in water, such as from about 5 square meters per gram to about 1000 square meters per gram.

Examples of such conditioning agents are the following:

I. Metal Oxides and Hydroxides having the formula: $M_aO_b.xH_2O$ and $M(OH)_c.xH_2O$, wherein M is Al, Fe, Co, Ni, Zn, Ti, Cr, Mn, Mg, Pb, Ca, Ba, In or Sb; a, b and c are whole numbers dependent upon the ionic valence of M; and x is a whole number within the range from 0 to about 3.

Preferably M is a metal selected from the group consisting of Al, Fe, Mg, Ca and Ba. These metal oxides and hydroxides are known materials. Particularly preferred are aluminum hydroxide gels in water at pH 7 to 7.5. Such compounds can be readily formed by mixing aqueous solutions of water-soluble aluminum compounds, for example, aluminum nitrate or aluminum acetate, with suitable hydroxides, for example, ammonium hydroxide. In addition, a suitable conditioning agent is formed by hydrolyzing bauxite ($Al_2O_3.xH_2O$) in alkaline medium to an alumina gel. Calcium hydroxide represents another preferred conditioning agent. Calcined calcium and magnesium oxides, and their hydroxides as set forth above, are also preferred conditioning agents. Mixtures of such compounds can very suitably be employed. The compounds are preferably suitably hydrolyzed prior to contacting with coal particles in accordance with the invention.

II. Metal aluminates having the formula:

$M'_d(AlO_3)_e$ or $M'_f(AlO_2)_g$, wherein M' in Fe, Co, Ni, Zn, Mg, Pb, Ca, Ba, or Mo; and d, e, f, and g are whole numbers dependent on the ionic valence of M'. Compounds wherein M' is Fe, Ca or Mg, i.e., iron, calcium and magnesium aluminates are preferred. These preferred compounds can be readily formed by mixing aqueous solutions of water-soluble calcium and magnesium compounds, for example, calcium or magnesium acetate with sodium aluminate. Mixtures of metal aluminates can very suitably be employed. The compounds are most suitably hydrolyzed prior to contacting with coal particles in accordance with the invention.

III. Aluminosilicates having the formula: $Al_2O_3.xSiO_2$, wherein x is a number within the range from about 0.5 to about 5.0.

A preferred aluminosilicate conditioning agent for use herein has the formula $Al_2O_3.4SiO_2$. Suitable aluminosilicates for use herein can be formed by mixing together in aqueous solution a water-soluble aluminum compound, for example, aluminum acetate, and a suitable alkali metal silicate, for example, sodium metasilicate, preferably, in suitable stoichiometric amounts to provide preferred compounds set forth above.

IV. Metal silicates wherein the metal is calcium, magnesium, barium, iron or tin.

Metal silicates can be complex mixtures of compounds containing one or more of the above mentioned metals. Such mixtures can be quite suitable for use as conditioning agents.

Calcium and magnesium silicates and mixtures thereof are among the preferred conditioning agents of this invention.

These conditioning agents can be prepared by mixing appropriate water-soluble metal materials and alkali metal silicates together in an aqueous medium. For example, calcium and magnesium silicates, which are among the preferred conditioning agents, can be prepared by adding a water soluble calcium and/or magnesium salt to an aqueous solution or dispersion of alkali metal silicate.

Suitable alkali metal silicates which can be used for forming the preferred conditioning agents are potassium silicates and sodium silicates. Alkali metal silicates for forming preferred calcium and magnesium conditioning agents for use herein are compounds having $SiO_2:M_2O$ formula weight ratios up to 4:1, wherein M represents an alkali metal, for example, K or Na.

Alkali metal silicate products having silica-to-alkali weight ratios ($SiO_2:M_2O$) up to about 2 are water-soluble, whereas those in which the ratio is above about 2.5 exhibit less water solubility, but can be dissolved by steam under pressure to provide viscous aqueous solutions or dispersions.

The alkali metal silicates for forming preferred conditioning agents are the readily available potassium and sodium silicates having $SiO_2:M_2O$ formula weight ratios up to 2:1. Examples of specific alkali metal silicates are anhydrous $Na_2SiO_3$ (sodium metasilicate), $Na_2Si_2O_5$ (sodium disilicate), $Na_4SiO_3$ (sodium orthosilicate), $Na_6Si_2O_7$ (sodium pyrosilicate) and hydrates, for example, $Na_2SiO_3.nH_2O$ (n=5, 7, 8 and 9), $Na_2Si_4O_9.7H_2O$ and $Na_3HSiO_4.5H_2O$. Examples of suitable water-soluble calcium and magnesium salts are calcium nitrate, calcium hydroxide and magnesium nitrate. The calcium and magnesium salts when mixed with alkali metal silicates described hereinbefore form very suitable conditioning agents for use herein.

Calcium silicates which hydrolyze to form tobermorite gels are especially preferred conditioning agents for use in the process of the invention.

V. Inorganic Cement Materials.

Inorganic cement materials are among the preferred conditioning agents of the invention. As used herein, cement material means an inorganic substance capable of developing adhesive and cohesive properties such that the material can become attached to mineral matter. Cement materials can be discrete chemical compounds, but most often are complex mixtures of compounds. The most preferred cements (and fortunately, the most readily available cements) are those cements capable of being hydrolyzed under ambient conditions, the preferred conditions of contacting with coal in the process of this invention.

These preferred cement materials are inorganic materials which, when mixed with a selected proportion of water, form a paste that can set and harden. Cement and materials used to form cements are discussed in Kirk-Othmer, Encyclopedia of Chemical Technology, 2nd Edition, volume 4, (1964), John Wiley & Sons, Inc., Pages 684 to 710 thereof are incorporated herein by reference. Examples of cement materials include calcium silicates, calcium aluminates, calcined limestone and gypsum. Especially preferred examples of cement materials are the materials employed in hydraulic limes, natural cement, masonry cement, pozzolan cement and portland cement. Such materials will often include magnesium cations in addition to calcium, e.g., dolomite.

Commerical cement materials, which are very suitable for use herein, are generally formed by sintering calcium carbonate (as limestone), or calcium carbonate (as limestone) with aluminum silicates (as clay or shale). Preferably, such materials are hydrolyzed prior to use as conditioning agents.

With some coals, the material matter associated with the coal may be such that on treatment under proper conditions of temperature and pH the mineral matter can be modified in situ to provide the suitable hydrolyzed inorganic conditioning agents for carrying out the process. In such cases, additional conditioning agents may or may not be required depending on whether an effective amount of conditioning agent is generated in situ.

The conditioning agents suitable for use herein can be employed alone or in combination.

The coal particles employed in this invention can be provided by a variety of known processes, for example, by grinding or crushing.

The particle size of the coal can vary over wide ranges. In general, the particles should be of a size to promote the removal of pyritic sulfur upon contacting with the conditioning agent in the aqueous medium. For instance, the coal may range from an average particle size of one-eighth inch in diameter to as small as minus 200 mesh (Tyler Screen) or smaller. Depending on the occurrence and mode of physical distribution of pyritic sulfur in the coal, the rate of sulfur removal will vary. In general, if the pyrite particles are relatively large and are liberated readily upon grinding, the sulfur removal rate will be faster and the sulfur removal will be substantial. If the pyrite particles are small and associated with the coal through surface contact or encapsulation, then the degree of grinding will have to be increased in order to provide for liberation of the pyrite particles. In a preferred embodiment of this invention, the coal particles are reduced in size sufficiently to effectuate liberation of sulfur and ash content and efficiency of conditioning. A very suitable particle size is often minus 24 mesh, or even minus 48 mesh as such sizes are readily separated on screens and sieve bends. For coals having fine pyrite distributed through the coal matrix, particle size distribution wherein from about 50 to about 85% preferably about 60 to about 75% pass through 200 mesh is a preferred feed with top sizes as set forth above.

The hydrocarbon oil employed may be derived from petroleum, shale oil, tar sand or coal. Petroleum oils are generally to be preferred primarily because of their ready availability and relatively low cost. Suitable petroleum oils will have a moderate viscosity, so that slurrying will not be rendered difficult, and a relatively high flash point, so that safe working conditions can be readily maintained. Such petroleum oils may be either wide-boiling range or narrow-boiling range fractions; may be paraffinic, naphthenic or aromatic; and preferably are selected from among light cycle oils, heavy cycle oils, clarified oils, gas oils, kerosenes and heavy napthas, and mixtures thereof. In addition, heavier oils may be used such as residual oil where the final product will be used as a boiler fuel.

The coal particles may be slurried by grinding and/or agitating in the presence of the hydrocarbon oil medium. Any suitable grinder, crusher or ball mill may be employed. Suitable suspensions of coal particles are achieved when employing at least 50 wt. % of slurry as hydrocarbon oil. More dilute slurries are generally employed and preferably the coal-oil slurry will contain from about 50 wt. % to about 80 wt. % of oil.

A minor amount of the conditioning agent is employed. Depending upon the choice of conditioning agent and its relative effectiveness in modifying or altering the surface characteristics of the ash and pyritic sulfur mineral matter, as little as 0.5 wt. % or even about 40%, based on mineral matter, can be added to the slurried coal particles, preferably from about 5 wt. % to about 25 wt. %. The conditioning agent may be added at the time the coal-hydrocarbon oil slurry is formed or thereafter. Contacting of the slurried coal particles with the conditioning agent is generally effected at a temperature within the range from 0° to 100° C., preferably 20° to 70° C., or more preferably ambient temperature, and contacted for a period of time ranging from about 1 minute to about 2 hours, preferably about 10 minutes to about 1 hour. The contacting temperature can be higher, however, i.e., above 100° C. Such higher temperature can be desirable if heavy hydrocarbon oils are employed. Such higher temperature can be 150° C. to 300° C. or higher. Such high temperatures will generally involve elevated pressures, and suitable vessels and other apparatus necessary for high pressure used must then be employed. The contacting can be effected by any available means for agitation, for example, by a mechanical mixer.

Agglomeration of the ash and pyritic sulfur mineral matter is effected by the addition of an effective but minor amount of water while maintaining agitation of the slurry, as by mixing or stirring. This latter agitation should be sufficient to effect good mixing of the water with the coal-oil slurry and to promote the formation of agglomerates comprising water and mineral matter. The mixing or stirring should not be so violent as to cause disintegration of the agglomerates. A suitable amount of water to be added for effecting the agglomeration will usually be within the range from about 0.5 wt. % to about 25 wt. %, based on mineral matter, more preferably, from 1% to 15 wt. %.

The conditioning agent and water may be added simultaneously although it may be necessary to add additional water thereafter, with stirring or mixing, to optimize the agglomeration.

Once agglomeration of the ash and pyritic sulfur mineral matter has been effected, the agglomerates can be separated by passage of the coal-oil slurry through a suitable screen or sieve bend or other suitable device for size separation. The separated agglomerates may be washed, to recover occluded oil, and then sent to available waste disposal facilities.

The resulting coal-oil slurry, freed of agglomerates, can be used as is as a desirable fuel or can be admixed wih addition hydrocarbon oil to be used as a fuel for installations employing coal-oil mixtures as fuel.

If desired, the coal-oil slurry, freed of agglomerates, can be separated into its component parts (coal and oil) by settling and decantation, filtering, or centrifuging to separate the oil phase and coal phase. Such a separation can be aided by first diluting with a light oil, such as heavy naphtha, to reduce the viscosity of the slurry and speed and separation of the beneficiated coal particles. The recovered coal particles reduced in sulfur and ash content can be washed with light oil, dried as required, and sent to storage or to downstream usage.

The hydrocarbon oils employed in this invention are hydrophobic and will preferentially wet hydrophobic material. It was recognized in this regard heretofore that coal and other existing pyritic sulfur mineral matter can have similar surface characteristics which make separation of pyrite from coal difficult. While not wishing to be bound by any particular theory, it is theorized that the conditioning agents can alter or modify the pyrite by associating with the pyrite or alter the existing pyrite surface physically or chemically to impart to the modified or altered pyrite surface more mineral-like surface characteristics. The chemical or physical altering of the surface can include the removal of surface constituents or impurities, thereby providing for separation of the pyrite from the coal upon agglomeration.

Since these altered or modified pyrite mineral surface characteristics differ from the surface characteristics of the coal particles, advantage can be taken of the differing surface characteristics at the time of agglomeration to separate the conditioned pyrite and coal.

Whatever the exact mechanism may be, it has been discovered that treating coal particles with a conditioning agent in accordance with this invention alters or modifies the surface characteristics of iron pyritic mineral matter associated with the coal particles. The result is that when the mixture of hydrocarbon oil, coal particles and water is agitated, the water preferentially wets (becomes associated with) the altered iron pyrite and ash particles, as opposed to the coal. These water wet pyrite and ash mineral matter particles will collide with one another under suitable agitation forming mineral matter-water agglomerates substantially free of coal. In general, the size of the agglomerates is generally at least about 2 to 3 times the average size of the coal particles which are suspended in the oil slurry.

As used herein, "mineral matter agglomerate" means an aggregate of a plurality of iron pyrite and ash particles. These agglomerates can have a wide range of particle sizes. For example, agglomerates include small aggregates or flocs formed of several mineral matter particles such that the aggregate if about 2 times, preferably from about 3 to 10 times, the average size of the coal particles which are present in the slurry. (Such small agglomerates can be referred to as flocs or aggregates and are included within the term agglomerate). Agglomerates can also include a large plurality of particles such that the agglomerate size is quite large. For example, agglomerates in the shape of balls having diameters of from about ⅛ inch to ½ inch, or larger may be formed.

Separating these mineral matter agglomerates provides coal particles exhibiting a diminished ash and pyritic sulfur content. In particular the coal particles exhibit reductions of from about 20% to 80% or more, by weight, ash and 20% to 80% or more, by weight, pyritic sulfur.

The resulting coal particles can also exhibit a diminished non-pyritic sulfur content, for example, in some coals up to 30%, by weight, of non-pyritic sulfur (i.e., sulfate, sulfur and/or apparent organic sulfur) may be removed.

An important aspect of this invention is the discovery that the conditioning agents employed herein modify both the ash and pyrite such that the ash and pyrite separate from water more quickly. The result is that disposal problems associated with these materials are substantially reduced, i.e., the agglomerates are easily dewatered to provide a solid disposable matter.

It is well known that disposal of the refuse from physical coal cleaning plants can present serious problems because the refuse, high in pyrite, weathers forming acidic material. Any resulting acid run-off is very deleterious. Another advantage of this invention is that the mineral matter refuse is modified such that weathering is attentuated.

In addition, since substantially all of the organic coal treated in the process of this invention can be recovered, unrecovered coal does not present a disposal problem, such as spontaneous combustion, which can occur in refuse piles.

It is another aspect of this invention that coal and coal-oil mixtures recovered from the process exhibit substantially improved fouling and slagging properties. Thus, the process can provide for improved removals of those inorganic constituents which cause high fouling and slagging in combustion furnaces.

What is claimed is:

1. A process for reducing the sulfur and ash content of coal comprising the steps of:

(a) providing a slurry in a hydrocarbon oil medium of coal particles containing ash and pyritic sulfur mineral matter;

(b) contacting the slurried coal particles with a promoting amount of at least one conditioning agent capable of modifying or altering the existing surface characteristics of the ash and pyritic sulfur mineral matter under conditions whereby there is effected modification or alteration of at least a portion of the contained ash and pyritic sulfur mineral matter;

(c) agglomerating the ash and pyritic sulfur mineral matter in said hydrocarbon oil slurry, while said surfaces are modified and altered, with water;

(d) separating the ash and pyritic sulfur mineral matter agglomerates from the hydrocarbon oil slurry; and (e) recovering a hydrocarbon oil-coal slurry wherein the coal particles have a reduced sulfur and ash content.

2. The process of claim 1 wherein the conditioning agent is an inorganic compound capable of hydrolyzing in the presence of water.

3. The process of claim 2 wherein the conditioning agent is an inorganic compound hydrolyzable in water to form a high surface area inorganic gel.

4. The process of claim 1 wherein the conditioning agent is selected from the group consisting of metal oxides and hydroxides having the formula $M_aO_b.xH_2O$ or $M(OH)_c.xH_2O$, wherein M is Al, Fe, Co, Ni, Zn, Ti, Cr, Mn, Mg, Pb, Ca, Ba, In or Sb; a, b and c are whole numbers dependent upon the ionic valence of M; and x is a whole number within the range from 0 to 3.

5. The process of claim 4 wherein the conditioning agent is selected from the group consisting of calcium oxide, magnesium oxide and mixtures thereof.

6. The process of claim 4 wherein the conditioning agent is selected from the group consisting of aluminum oxide, aluminum hydroxide and mixtures thereof, hydrolyzed in water to form an alumina gel.

7. The process of claim 1 wherein the conditioning agent is selected from the group consisting of metal aluminates having the formula $M'_d(AlO_3)_e$ or $M'_f(AlO_2)_g$, wherein M' is Fe, Co, Ni, An, Mg, Pb, Ca, Ba or Mo; and d, e, f and g are whole numbers dependent upon the ionic valence of M'.

8. The process of claim 7 wherein the conditioning agent is selected from the group consisting of calcium, magnesium, and iron aluminates and mixtures thereof.

9. The process of claim 1 wherein the conditioning agent is selected from the group consisting of aluminosilicates having the formula $Al_2O_3.SiO_2$ wherein x is a number within the range from about 0.5 to about 5.0.

10. The process of claim 1 wherein the conditioning agent is selected from the group consisting of metal silicates wherein the metal is calcium, magnesium, barium, iron or tin.

11. The process of claim 10 wherein the conditioning agent is selected from the group consisting of calcium silicate, magnesium silicate and mixtures thereof.

12. The process of claim 1 wherein the conditioning agent is selected from the group consisting of inorganic cement materials capable of binding mineral matter.

13. The process of claim 12 wherein the conditioningagent is selected from the group consisting of portland cement, natural cement, masonry cement, pozzolan cement, calcined limestone and calcined dolomite.

14. The process of claim 13 wherein the cement material is hydrolyzed portland cement.

15. The process of claim 1 wherein the slurry of coal particles contains at least 50% by weight of hydrocarbon oil.

16. The process of claim 15 wherein the slurry of coal particles contains from about 50% to about 80% by weight of hydrocarbon oil.

17. The process of claim 1 wherein the hydrocarbon oil is derived from petroleum, shale oil, tar sands or coal.

18. The process of claim 1 wherein the hydrocarbon oil is selected from the group consisting of light cycle oil, heavy cycle oil, gas oil, clarified oil, kerosene, heavy naphtha and residual oil.

19. The process of claim 18 wherein the hydrocarbon oil is residual oil.

20. The process of claim 1 wherein the slurried coal particles are contacted with from about 0.5 wt. % to about 40 wt. %, based on ash and mineral matter, of the conditioning agent.

21. The process of claim 1 wherein the slurried coal particles are contacted with the conditioning agent at a temperature within the range from 0° to 100° C.

22. The process of claim 20 wherein the temperature is within the range from 20° to 70° C.

23. The process of claim 1 wherein the slurried coal particles are contacted with the conditioning agent for a period of time within the range from 1 minute to 2 hours.

24. The process of claim 22 wherein the period of time is within the range from 10 minutes to 1 hour.

25. The process of claim 1 wherein the ash and pyritic sulfur mineral matter is agglomerated with the addition of from 0.5 wt. % to 25 wt. %, based on ash and mineral matter, of water.

26. The process of claim 1 wherein the coal is selected from the group consisting of bituminous coal and higher ranked coal.

27. The process of any one of claims 1, 2 or 3 wherein steps (b) and (c) are conducted substantially simultaneously.

28. The process of any one of claims 1, 2 or 3 wherein coal particles having a reduced sulfur and ash content are recovered.

29. The process of any one of claims 4, 5 or 6 wherein steps (b) and (c) are conducted substantially simultaneously.

* * * * *